US010240784B2

(12) United States Patent
Skachkov et al.

(10) Patent No.: US 10,240,784 B2
(45) Date of Patent: Mar. 26, 2019

(54) BURNER ASSEMBLY FOR FLARING LOW CALORIFIC GASES

(71) Applicant: Schlumberger Technology Corporation, Sugar Land, TX (US)

(72) Inventors: Roman Alexandrovich Skachkov, Novosibirsk (RU); Christian Menger, Recke (DE); Mikhail Petrovich Gusev, Krasnoobsk (RU); Konstantin Mikhailovich Serdyuk, Novosibirsk (RU); Vladimir Konstantinovich Khan, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 272 days.

(21) Appl. No.: 14/899,343

(22) PCT Filed: Jun. 17, 2013

(86) PCT No.: PCT/RU2013/000503
§ 371 (c)(1),
(2) Date: Dec. 17, 2015

(87) PCT Pub. No.: WO2014/204333
PCT Pub. Date: Dec. 24, 2014

(65) Prior Publication Data

US 2016/0131361 A1 May 12, 2016

(51) Int. Cl.
*F23G 5/24* (2006.01)
*F23G 7/08* (2006.01)
(Continued)

(52) U.S. Cl.
CPC ..... *F23G 7/085* (2013.01); *F23D 14/20* (2013.01); *F23D 14/70* (2013.01); *F23G 5/24* (2013.01);
(Continued)

(58) Field of Classification Search
None
See application file for complete search history.

(56) References Cited

U.S. PATENT DOCUMENTS 1,206,153 A * 11/1916 Smith ..... B05B 7/10 239/403
1,697,048 A * 1/1929 Cox ..... F23D 1/00 110/104 B
(Continued)

FOREIGN PATENT DOCUMENTS

GB 2043232 A * 10/1980
RU 64323 U1 6/2007
(Continued)

OTHER PUBLICATIONS

International Preliminary Report on Patentability issued in the related PCT application PCT/RU2013/000503 dated Dec. 22, 2015 (11 pages).
(Continued)

*Primary Examiner* — Avinash A Savani
*Assistant Examiner* — Martha M Becton
(74) *Attorney, Agent, or Firm* — Cameron R. Sneddon

(57) ABSTRACT

A burner assembly (100) for flaring low calorific gases, such as methane with high carbon dioxide content, may be configured to provide a gradual decrease in flow velocity. The burner assembly (100) may include a conical deflector (140) that creates a relatively large recirculation zone (154) downstream of the deflector (140), thereby to stabilize fluid flow. A swirl inducing structure positioned in a final stage of
(Continued)

the burner assembly (100) further stabilizes the fluid flow and flame at different gas flow rates.

20 Claims, 4 Drawing Sheets

(51) Int. Cl.
*F23D 14/70* (2006.01)
*F23D 14/20* (2006.01)

(52) U.S. Cl.
CPC ..... *F23D 2900/14241* (2013.01); *F23G 2200/00* (2013.01)

(56) References Cited

U.S. PATENT DOCUMENTS 2,267,025 A * 12/1941 Grindle ..... F23D 1/00 431/174
2,360,548 A * 10/1944 Conway ..... F23D 14/22 431/186
3,049,085 A * 8/1962 Musat ..... F23D 1/00 431/183
3,796,209 A * 3/1974 Luft ..... A01G 13/06 126/59.5
3,904,349 A * 9/1975 Peterson ..... F23C 7/004 239/404
4,003,693 A * 1/1977 Straitz, III ..... F23G 7/085 239/403
4,323,343 A 4/1982 Reed et al.
4,462,795 A * 7/1984 Vosper ..... F23C 5/14 431/350
4,479,442 A * 10/1984 Itse ..... F23D 1/02 110/104 R
4,768,948 A * 9/1988 Hansen ..... F23D 1/00 110/263
4,879,959 A 11/1989 Korenberg
5,199,355 A * 4/1993 Larue ..... F23D 1/02 110/261
5,284,437 A * 2/1994 Aigner ..... F23D 11/402 431/190
5,295,816 A * 3/1994 Kobayashi ..... C03B 5/235 431/159
5,567,141 A * 10/1996 Joshi ..... F23D 11/106 239/419
5,588,380 A * 12/1996 LaRose ..... F23D 1/00 110/263
5,685,242 A * 11/1997 Narato ..... F23C 6/047 110/104 B
5,697,306 A * 12/1997 LaRue ..... F23D 1/02 110/261
5,758,587 A 6/1998 Buchner et al.
5,810,575 A * 9/1998 Schwartz ..... F23G 7/085 431/5
5,823,759 A * 10/1998 Swithenbank ..... F23G 7/085 431/115
5,829,367 A * 11/1998 Ohta ..... F23D 1/00 110/261
6,027,332 A * 2/2000 Glotin ..... F23C 7/02 239/403
6,190,163 B1 * 2/2001 Maricic ..... F23D 14/04 239/556
6,390,805 B1 * 5/2002 Paschereit ..... F23C 7/002 431/10
6,524,098 B1 2/2003 Tsirulnikov et al.
6,889,619 B2 * 5/2005 Okazaki ..... F23C 6/045 110/187
7,448,218 B2 11/2008 Heilos et al.
8,814,560 B2 * 8/2014 Le Mer ..... F23D 14/70 431/12
2008/0280238 A1 11/2008 Smith et al.
2015/0316257 A1 * 11/2015 Skachkov ..... F23G 7/08 431/202

FOREIGN PATENT DOCUMENTS

RU 2315239 C1 1/2008
RU 2324117 C1 5/2008
RU 2477423 C1 3/2013

OTHER PUBLICATIONS

Decision of Grant issued in the related RU application 2016101070, dated Mar. 23, 2017 (22 pages).
Industrial Burners Handbook, CRC Press, 2000, p. 237, p. 579.
A. Valera-Medina et al., Central recirculation zone analysis in an unconfined tangential swirl burner with varying degrees of premixing—Exp Fluids, 2011, vol. 50, p. 1611-1623.
Huang et al., Effect of swirl on combustion dynamics in a lean-premixed swirl-stabilized combustor—Proceedings of the Combustion Institute, vol. 30, Issue 2, 2005, p. 1775-1782.
International Search Report issued in PCT/RU2013/000503 dated Mar. 13, 2014; 8 pages.
Written Opinion of the International Searching Authority issued in PCT/RU2013/000503 dated Feb. 27, 2014; 10 pages.

* cited by examiner

BURNER ASSEMBLY FOR FLARING LOW CALORIFIC GASES

BACKGROUND OF THE DISCLOSURE

Hydrocarbons are widely used as a primary source of energy, and have a significant impact on the world economy. Consequently, the discovery and efficient production of hydrocarbon resources is increasingly important. As relatively accessible hydrocarbon deposits are depleted, hydrocarbon prospecting and production has expanded to new regions that may be more difficult to reach and/or may pose new technological challenges. During typical operations, a borehole is drilled into the earth, whether on land or below the sea, to reach a reservoir containing hydrocarbons. Such hydrocarbons are typically in the form of oil, gas, or mixtures thereof which may then be brought to the surface through the borehole.

Well testing is often performed to help evaluate the possible production value of a reservoir. During well testing, a test well is drilled to produce a test flow of fluid from the reservoir. During the test flow, key parameters such as fluid pressure and fluid flow rate are monitored over a time period. The response of those parameters may be determined during various types of well tests, such as pressure drawdown, interference, reservoir limit tests, and other tests generally known by those skilled in the art. The data collected during well testing may be used to assess the economic viability of the reservoir. The costs associated with performing the testing operations are significant, however, and may exceed the cost of drilling the test well. Accordingly, testing operations should be performed as efficiently and economically as possible.

One common procedure during well testing operations is flaring a gas flow associated with the well effluent. Many types of burners and flares are known that can efficiently combust gas flows having relatively high colorific content (i.e., a relatively high percentage of methane) without producing significant smoke or fallout. That is because, with a high calorific content, a high velocity gas jet may thoroughly mix with minimal risk of blowing out the flame.

It is more difficult, however, to cleanly burn gas flows having low calorific content, also known as "lean gases." Lean gas flows may have a relatively high proportion of inert gases, such as nitrogen, which dilute the flammable content of the gas and therefore increase the risk of quenching the flame. Other inert gases, such as carbon dioxide, do not simply dilute the gas but may also actively inhibit flame when present in certain concentrations, such as greater than 35% of the gas flow content. Even at concentrations less than 35%, the flame inhibiting inert gases such as carbon dioxide may significantly increase the risk of flame blow-off.

Various burner designs have been proposed for combusting gas having a low calorific content. In general, the proposed burners require complex gas flow paths that are susceptible to clogging, have complex designs that complicate construction and maintenance, and/or are otherwise unsuitable for flaring waste fuel during well testing operations.

SUMMARY OF THE DESCRIPTION

In accordance with certain aspects of the disclosure, a burner assembly is provided for flaring a low calorific gas. The burner assembly may include a burner pipe disposed along a burner pipe axis and having an inlet pipe having an inlet pipe cross-sectional area extending substantially perpendicular to the burner pipe axis, an intermediate pipe coupled to the inlet pipe and having an intermediate pipe cross-sectional area extending substantially perpendicular to the burner pipe axis that is greater than the inlet pipe cross-sectional area, and an expander pipe coupled to the intermediate pipe and having an expander pipe cross-sectional area extending substantially perpendicular to the burner pipe axis that is greater than the intermediate pipe cross-sectional area. A hub may be disposed within a downstream portion of the expander pipe and have a hub upstream end facing the intermediate pipe and a hub downstream end. A plurality of guide vanes may interconnecting the expander pipe and the hub, and a deflector may be coupled to the hub and have a deflector exterior surface with a substantially frustoconical shape extending radially outwardly from the burner pipe axis and axially downstream of the hub downstream end, wherein the deflector exterior surface is oriented at a deflector surface angle relative to the burner pipe axis.

In accordance with additional aspects of the disclosure, a method of flaring a low calorific gas may include flowing the low calorific gas through a burner pipe disposed along a burner pipe axis, the burner pipe including an inlet pipe having a relatively small cross-sectional area, an intermediate pipe having an intermediate cross-sectional area, and an expander pipe having a relatively large cross-sectional area, wherein the low calorific gas flows successively through the inlet pipe, intermediate pipe, and expander pipe. A central portion of the relatively large cross-sectional area of the expander pipe may be obstructed with a hub disposed at a downstream portion of the expander pipe to create a perimeter gas flow along the expander pipe. The perimeter gas flow may be rotated about the burner pipe axis to create a swirling gas flow exiting the expander pipe. A recirculation flow may be generated downstream of the expander pipe by directing the swirling gas flow radially outwardly along an exterior surface of a deflector, the deflector exterior surface having a substantially frustoconical shape.

The summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of burner assemblies and flaring methods suitable for combusting gas flows having low calorific content are described with reference to the following figures. The same numbers are used throughout the figures to reference like features and components.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

So that the above features and advantages of the present disclosure can be understood in detail, a more particular description of the disclosure, briefly summarized above, may be had by reference to the embodiments thereof that are illustrated in the accompanying drawings. It is to be noted, however, that the drawings illustrate only typical embodiments of this disclosure and therefore are not to be considered limiting of its scope, for the disclosure may admit to other equally effective embodiments.

Burner assemblies and methods are disclosed herein for use with a gas flow having a low calorific content, such as waste effluent from a supply line formed during well testing operations. The generic term used to describe such waste effluent is often roughly termed a gas flow to be combusted. In general, the assemblies and methods are adapted to decelerate the superficial velocity of the gas flow provided by the supply line to prevent flame blow-off, and to create a large recirculation zone downstream of the burner to ensure flame stability.

Figure 1:
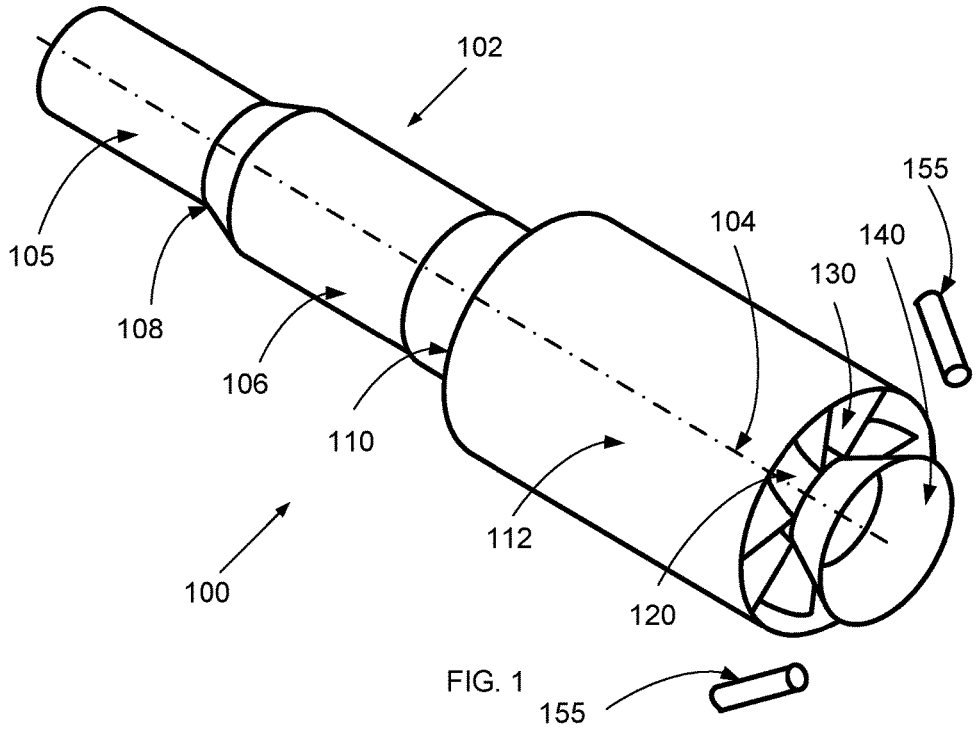
FIG. 1 is a perspective view of a burner assembly for a low calorific content gas flow constructed according to the present disclosure.

FIG. 1 illustrates a burner assembly 100 adapted to combust a low calorific content gas flow across a wide range of superficial gas velocities. The gas flow may be communicated to the burner from any source, such as a supply line of a test well (not shown). The gas flow includes a flammable component, such as methane, as well as one or more inert gases, such as nitrogen, water vapor, and/or carbon dioxide.

The burner assembly 100 includes a burner pipe 102 disposed along a burner pipe axis 104 and having a plurality of stages. In the illustrated embodiment the burner pipe 102 has three stages; however other embodiments of the burner pipe may have a different number of stages. More specifically, the burner pipe 102 may include an inlet pipe 105, an intermediate pipe 106 having an intermediate pipe upstream end 108 coupled to the inlet pipe 105 and an intermediate pipe downstream end 110, and an expander pipe 112 coupled to the intermediate pipe downstream end 110. The stages of the burner pipe 102 are sized so that the gas flow successively encounters a larger cross-sectional area within the burner pipe 102. Accordingly, the inlet pipe 105 may have an inlet pipe cross-sectional area that is relatively small, the intermediate pipe 106 may have an intermediate pipe cross-sectional area that is larger than the inlet pipe cross-sectional area, and the expander pipe 112 may have an expander pipe cross-sectional area that is larger than the intermediate pipe cross-sectional area.

Figure 2:
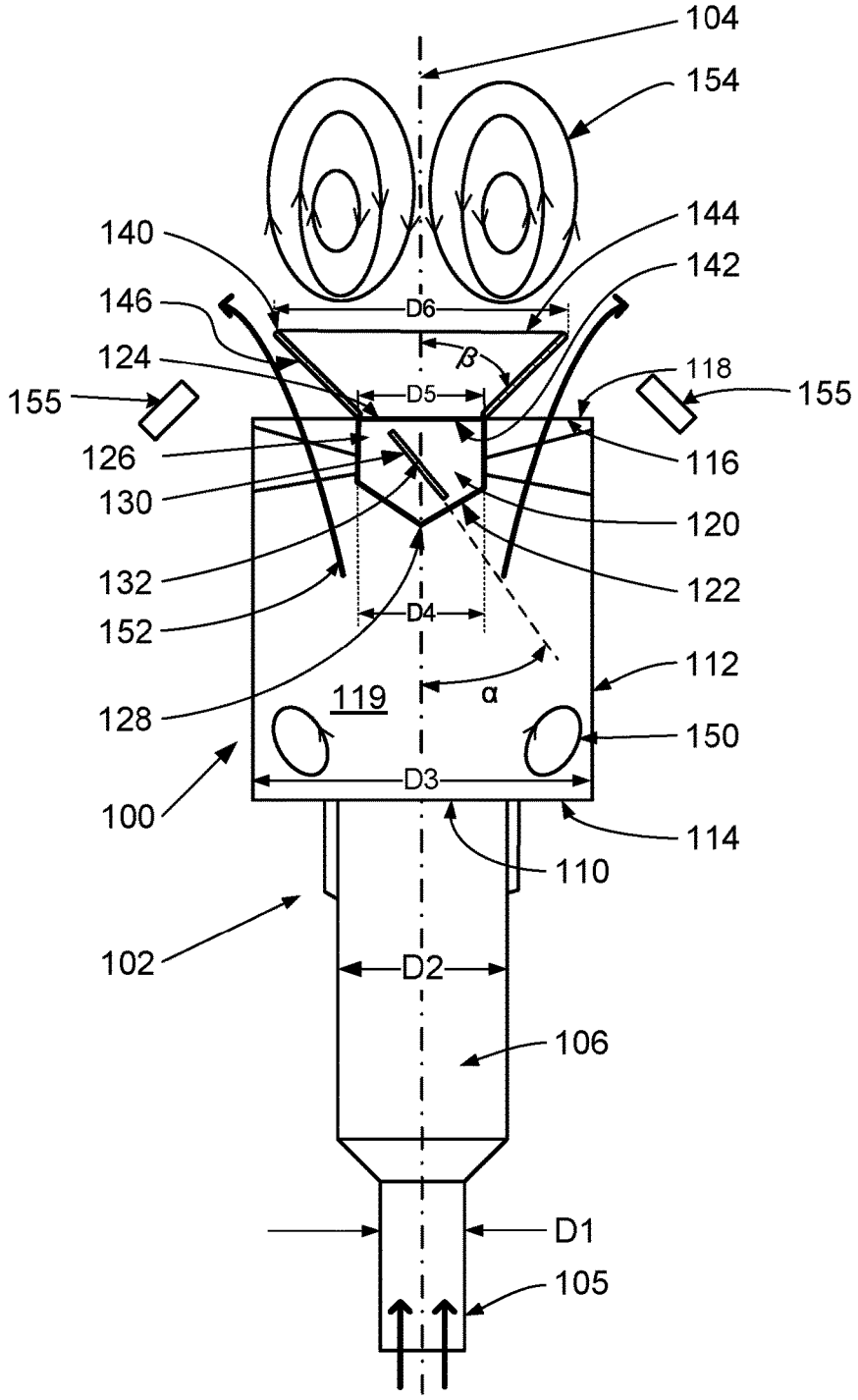
FIG. 2 is a side elevation view, in cross-section, of the burner assembly of FIG. 1 operating with a low superficial velocity gas flow.

In the illustrated embodiment, the inlet pipe 105, intermediate pipe 106, and expander pipe 112 are shown as having generally cylindrical shapes. Accordingly, the relative sizes of the cross-sectional areas of the pipes may be determined based on their respective diameters. For example, the inlet pipe 105 may have an inlet pipe diameter D1, the intermediate pipe 106 may have an intermediate pipe diameter D2, and the expander pipe 112 may have an expander pipe diameter D3. Furthermore, as shown in FIG. 2, the intermediate pipe diameter D2 is larger than the inlet pipe diameter D1, and the expander pipe diameter D3 is larger than the intermediate pipe diameter D2. It will be appreciated, however, that the inlet, intermediate, and expander pipes 105, 106, 112 may be provided in non-cylindrical shapes.

The expander pipe 112 may include an expander pipe upstream end 114 coupled to and fluidly communicating with the intermediate pipe 106, and an expander pipe downstream end 116 open to atmosphere and therefore defining a burner pipe outlet 118. A hub 120 may be disposed in a downstream portion of the burner pipe 102 adjacent the expander pipe downstream end 116. In the illustrated embodiment, the hub 120 is concentric with, and has an overall profile shape that is substantially symmetrical relative to, the burner pipe axis 104. The hub 120 may include a hub upstream end 122 generally facing the intermediate pipe 106, a hub downstream end 124 opposite the hub upstream end 122, and a hub side wall 126 connecting the hub upstream and downstream ends 122, 124. The hub upstream end 122 may have a conical shape defining an apex 128 disposed substantially along the burner pipe axis 104. The hub side wall 126 may be cylindrical and have a diameter D4 defining a maximum hub cross-sectional area extending substantially perpendicular to the burner pipe axis 104. To create a perimeter gas flow along the inside surface of the expander pipe 112, as described in greater detail below, the hub 120 may be sized to obstruct a central portion of an expander chamber 119 defined by the expander pipe 112. In some applications, the maximum hub cross-sectional area may be approximately 30 to 50% of the expander pipe cross-sectional area to create the desired perimeter gas flow. The hub downstream end 124 may be substantially planar as shown in FIG. 2.

A plurality of guide vanes 130 may extend between the expander pipe 112 and the hub 120 to hold the hub 120 in position within the expander pipe 112 and to impart a rotation to the gas flow, as described in greater detail below. The number of guide vanes 130 may be selected so that there are a sufficient number to produce the desired rotational flow but not so many as to restrict flow or create a significant risk of catching debris entrained in the gas flow. Accordingly, approximately 3 to 8 guide vanes 130 may be provided in the burner assembly 100. Each guide vane 130 may include a guide vane upstream surface 132 facing upstream toward the intermediate pipe 106 and oriented at a guide vane angle a relative to the burner pipe axis 104. In some embodiments, the guide vane angle a may be approximately 20 to 45 degrees. Additionally, the guide vanes may be configured to have profiles that increase the efficiency with which rotation is imparted to the gas flow.

A deflector 140 may be positioned downstream of the burner pipe 102 to stabilize the flame during operation. As shown in FIGS. 1 and 2, the deflector 140 may have a deflector upstream end 142 coupled to the downstream end 124 of the hub 120, and a deflector downstream end 144. The deflector 140 may include a deflector exterior surface 146 having a substantially frustoconical shape. More specifically, the deflector exterior surface 146 may extend radially outwardly from the burner pipe axis 104 and axially downstream from the deflector upstream end 142 to the deflector downstream end 144. Accordingly, the deflector upstream end 142 may define a deflector upstream end diameter D5 that is smaller than a deflector downstream end diameter D6 defined by the deflector downstream end 144. The deflector downstream end diameter D6 may be sized relative to the expander pipe diameter D3 to induce the desired gas flow pattern downstream of the burner pipe 102. For example, the deflector downstream end diameter D6 may be approximately 60 to 80% of the expander pipe diameter D3. Additionally, the deflector exterior surface 146 influences the flow pattern produced by the deflector 140. In the illustrated embodiment, the deflector exterior surface 146 is oriented along a deflector surface angle β relative to the burner pipe axis 104. In some applications, the deflector surface angle β may be approximately 20 to 45 degrees to produce the desired gas flow pattern.

In operation, the gas flow is communicated to the burner assembly 100. As the gas flow travels through the burner pipe 102, the successively larger cross-sectional areas of the inlet pipe 105, intermediate pipe 106, and expander pipe 112 will reduce the superficial velocity of the gas flow. As the gas flow enters the expander pipe 112 from the intermediate pipe 106, the relatively large and abrupt change in cross-sectional area may produce an internal recirculation zone 150 in the upstream portion of the expander pipe 112.

The hub 120 may obstruct a central portion of the gas flow through the downstream portion of the expander pipe 112, thereby to create a perimeter gas flow 152. The guide vanes 130 may impart a rotation of the perimeter gas flow generally centered about the burner pipe axis 104, thereby to create a swirling gas flow, which may be substantially helical, as the gas flow exits the expander pipe 112. Downstream of the burner pipe 102, the deflector 140 directs the swirling gas flow radially outwardly, which creates a relatively large exterior recirculation zone 154 downstream of the deflector 140. This exterior recirculation zone 154 further reduces gas flow velocity, thereby promoting stable and efficient combustion of the gas flow.

Additionally, the burner assembly 100 is equipped with a set of pilot burners 155 needed for ignition of flame and stabilization of gas burning. The set of burners 155 may be positioned at the outer edge of the expander pipe 112. FIGS. 1 and 2 depict two pilot burners installed at the opposite sides of the expander pipe 112 in the zone of low flow velocity. However, the number and positions of pilot burners 155 may vary in size, type and location, deepening on the parameters of the operation, cost, safety requirements and/or convenience for an operator.

The burner assembly 100 may create stable combustion of low calorific content gas flow under a variety of gas flow pressures and related superficial velocities. FIG. 2, for example, illustrates a sub-sonic gas flow through the burner. The superficial velocity of the gas flow may be determined by dividing the gas flow rate Q by the cross-sectional area A of the body through which it flows. With a known gas flow rate Q, the cross-sectional area A of the intermediate pipe 106 may be sized so that the superficial gas velocity Q/A is less than a sonic speed of the gas. When the superficial gas velocity is sub-sonic, the burner assembly 100 will decelerate the gas flow through the successive stages of the burner pipe 102, and the swirling gas flow pattern exiting the burner pipe 102 will be directed over the deflector 140 to create the exterior recirculation zone 154.

Figure 3:
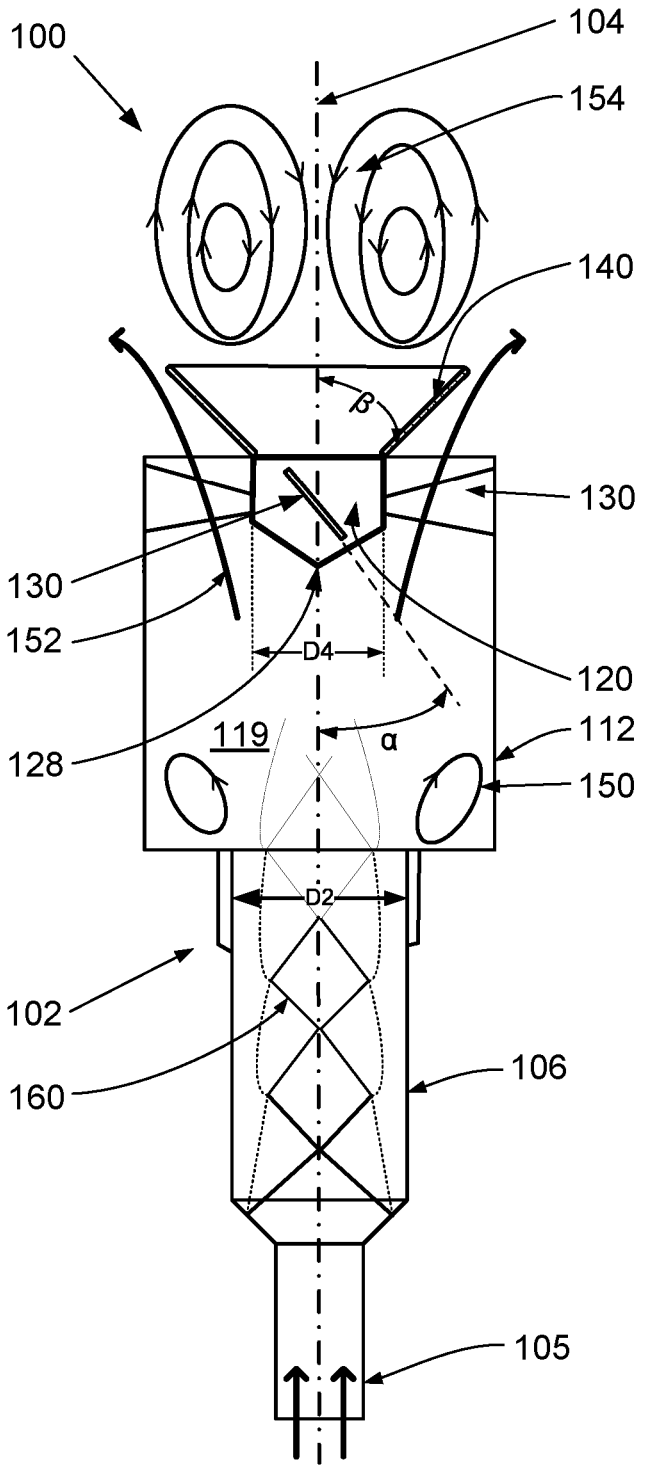
FIG. 3 is a side elevation view, in cross-section, of the burner assembly of FIG. 1 operating with an intermediate superficial velocity gas flow.

FIG. 3 illustrates a gas flow rate that is substantially equal to the sonic flow rate in the intermediate pipe 106. The burner assembly 100 operates in substantially the same fashion as noted above, with the exception that the incoming gas flow pressure and/or intermediate pipe cross-sectional area are selected so that the superficial gas velocity in the intermediate pipe 106 is substantially equal to the sonic velocity of the gas. As the superficial gas velocity achieves the sonic velocity in the inlet pipe 105, a pattern of oblique shock waves 160 is generated within the intermediate pipe 106. The shock wave pattern 160 is formed due to the increase in cross-sectional area of the intermediate pipe 106 as compared with inlet pipe 105. The shock wave pattern 160 is illustrated in FIG. 3 as a series of substantially conical structures. Traveling further downstream the burner pipe 102, the shock wave cells 160 dissipate and the gas flow expands in the expander pipe 112 to flow at a sub-sonic velocity. The remainder of the gas pattern around the hub 120, through the guide vanes 130, and over the deflector 140 is substantially the same as that described above in connection with FIG. 2.

Figure 4:
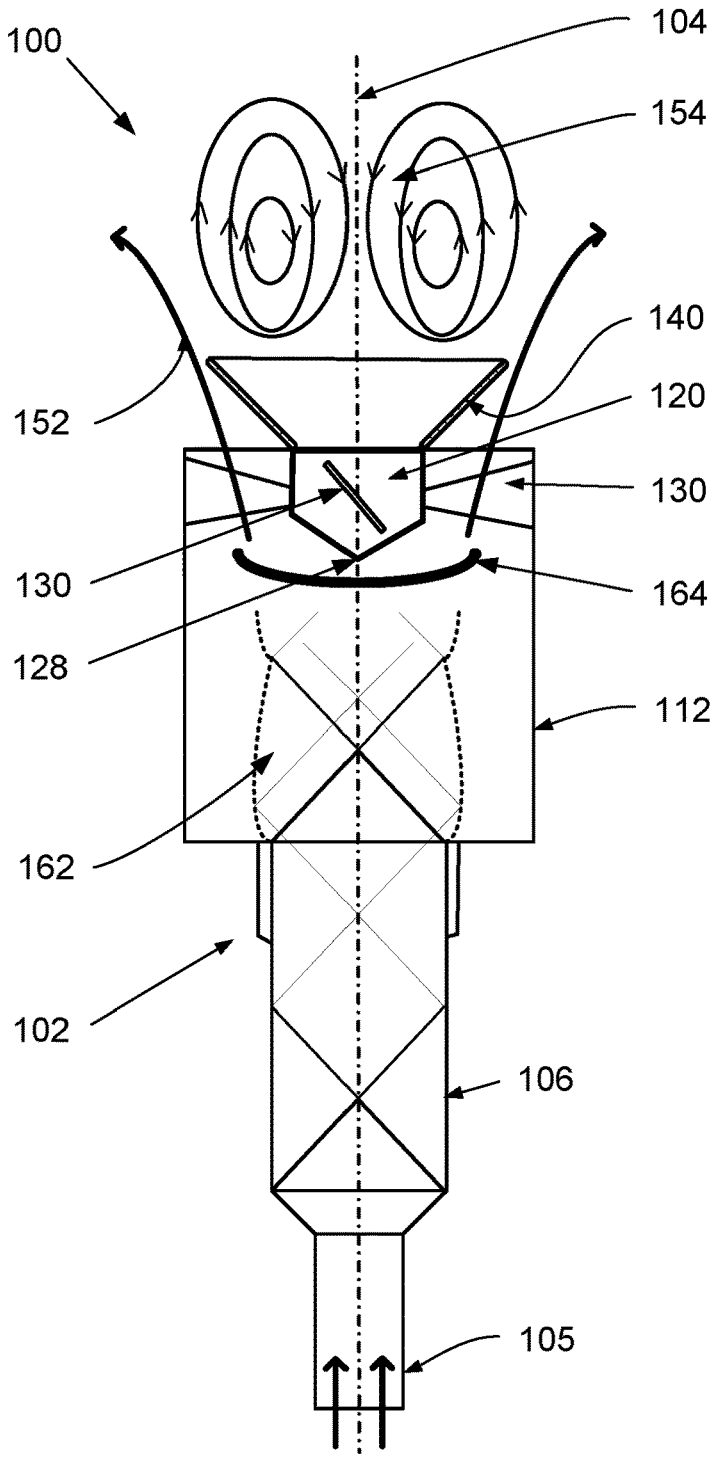
FIG. 4 is a side elevation view, in cross-section, of the burner assembly of FIG. 1 operating with a high superficial velocity gas flow.

FIG. 4 illustrates a gas flow having a superficial gas velocity that is at a supersonic velocity in the intermediate pipe 106. In FIG. 4, the gas flow does not near the sonic or sub-sonic velocity until it flows through the expander pipe 112. As shown in FIG. 4, the supersonic velocity of the gas will generate shock wave cells 162 within the expander pipe 112 that partly dissipate the energy of the gas flow. As the gas flow approaches the hub 120, a direct shock wave 164 may be formed at the upstream apex 128 of the hub 120. The gas flow may continue around the hub 120, through the guide vanes 130, and over the deflector 140 substantially as described above in connection with FIGS. 2 and 3.

In view of the foregoing, burner assemblies and methods are provided that may efficiently combust low calorific content gas under a variety of pressures. As noted above, a gas flow pattern conducive to a stable flame is produced under subsonic, sonic, and supersonic gas velocities through the burner pipe 102. The low amount of swirling induced by the guide vanes 130 stabilizes the gas flow and shortens the flame length. The conical deflector 140 further keeps the flame near the burner pipe outlet, thereby reducing the possibility of flame blow-off. In addition to creating the perimeter flow pattern, the hub 120 also helps prevent flashback by obstructing flow through the central portion of the expander pipe 112.

Although only a few example embodiments have been described in detail above, those skilled in the art will readily appreciate that many modifications are possible in the example embodiments without materially departing from the burner assembly and methods for flaring low calorific content gases disclosed and claimed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A burner assembly (100) for flaring a low calorific gas flowing through an inlet pipe, the burner assembly (100) comprising:

a burner pipe (102) disposed along a burner pipe axis (104), the burner pipe (102) including an expander pipe (112) coupled to an intermediate pipe (106) and having an expander pipe cross-sectional area extending substantially perpendicular to the burner pipe axis (104) that is greater than a first pipe cross-sectional area, the intermediate pipe (106) extending between the inlet pipe and the expander pipe (112) to reduce a velocity of the low calorific gas flow;

a hub (120) disposed within a downstream portion of the expander pipe (112), the hub (120) having a hub upstream end (122) facing an upstream portion of the expander pipe (112) and a hub downstream end (124);

a plurality of guide vanes (130) interconnecting the expander pipe (112) and the hub (120), each of the guide vanes (130) includes a guide vane upstream surface (132) facing the upstream portion of the expander pipe (112); and a deflector (140) coupled to the hub (120) and having a deflector exterior surface (146) with a substantially frustoconical shape extending radially outwardly from the burner pipe axis (104) and axially downstream of the hub downstream end (124), the deflector exterior surface (146) being oriented at a deflector surface angle (β) relative to the burner pipe axis (104).

2. The burner assembly (100) of claim 1, in which the deflector surface angle (β) is approximately 20 to 45 degrees.

3. The burner assembly (100) of claim 1, in which each of the guide vane upstream surfaces (132) is oriented at a guide vane angle (α) relative to the burner pipe axis (104), and in which the guide vane angle (a) is approximately 20 to 45 degrees.

4. The burner assembly (100) of claim 1, in which the hub (120) defines a maximum hub cross-sectional area extending substantially perpendicular to the burner pipe axis (104), and in which the maximum hub cross-sectional area is approximately 30 to 50 percent of the expander pipe cross-sectional area.

5. The burner assembly (100) of claim 1, in which:

the expander pipe (112) is cylindrical and defines an expander pipe diameter (D3);

the deflector (140) includes a deflector downstream end (144) defining a deflector downstream end diameter (D6); and the deflector downstream end diameter (D6) is approximately 60 to 80 percent of the expander pipe diameter (D3).

6. The burner assembly (100) of claim 5, in which the deflector (140) includes a deflector upstream end (142) defining a deflector upstream end diameter (D5), and in which the deflector downstream end diameter (D6) is larger than the deflector upstream end diameter (D5).

7. The burner assembly (100) of claim 1, wherein the intermediate pipe (106) has a second pipe cross-sectional area extending substantially perpendicular to the burner pipe axis (104) that is greater than the first pipe cross-sectional area and less than the expander pipe cross-sectional area.

8. The burner assembly (100) of claim 7, in which the low calorific gas has a superficial gas velocity through the intermediate pipe (106), and the second pipe cross-sectional area is sized so that the superficial gas velocity is equal to a subsonic gas velocity.

9. The burner assembly (100) of claim 7, in which the low calorific gas has a superficial gas velocity through the intermediate pipe (106), and the second pipe cross-sectional area is sized so that the superficial gas velocity is substantially equal to a sonic gas velocity.

10. The burner assembly (100) of claim 7, in which the low calorific gas has a superficial gas velocity through the intermediate pipe (106), and the second pipe cross-sectional area is sized so that the superficial gas velocity is substantially equal to a supersonic gas velocity.

11. The burner assembly (100) of claim 1, in which the hub upstream end (122) has a conical shape defining an apex (128) extending toward the upstream portion of the expander pipe (112).

12. The burner assembly (100) of claim 11, in which the apex (128) is disposed substantially along the burner pipe axis (104).

13. The burner assembly (100) of claim 1, in which the hub (120) is substantially symmetrical about the burner pipe axis (104).

14. A burner assembly (100) for flaring a low calorific gas flowing through a cylindrical inlet pipe, the burner assembly (100) comprising:

a burner pipe (102) disposed along a burner pipe axis (104), the burner pipe (102) including an expander pipe (112) coupled to an intermediate pipe (106) and having an expander pipe cross-sectional area extending substantially perpendicular to the burner pipe axis (104) that is greater than a first pipe cross-sectional area, the intermediate pipe (106) extending between the cylindrical inlet pipe and the expander pipe (112) to reduce a velocity of the low calorific gas flow;

a hub (120) disposed within a downstream portion of the expander pipe (112), the hub (120) having a hub upstream end (122) facing an upstream portion of the expander pipe (112) and a hub downstream end (124), the hub (120) defining a maximum hub cross-sectional area extending substantially perpendicular to the burner pipe axis (104), and in which the maximum hub cross-sectional area is approximately 30 to 50 percent of the expander pipe cross-sectional area;

a plurality of guide vanes (130) interconnecting the expander pipe (112) and the hub (120), each of the plurality of guide vanes (130) including a guide vane upstream surface (132) facing the upstream portion of the expander pipe (112) and oriented at a guide vane angle (α) of approximately 20 to 45 degrees relative to the burner pipe axis (104); and a deflector (140) coupled to the hub (120) and having a deflector exterior surface (146) with a substantially frustoconical shape extending radially outwardly from the burner pipe axis (104) and axially downstream of the hub downstream end (124), the deflector exterior surface (146) being oriented at a deflector surface angle (β) of approximately 20 to 45 degrees relative to the burner pipe axis (104).

15. The burner assembly (100) of claim 14, in which the deflector (140) includes a deflector downstream end (144) defining a deflector downstream end diameter (D6), and the deflector downstream end diameter (D6) is approximately 60 to 80 percent of an expander pipe diameter (D3).

16. A method of flaring a low calorific gas flowing through a first pipe, comprising:

flowing the low calorific gas through a burner pipe (102) disposed along a burner pipe axis (104), the burner pipe (102) including an expander pipe (112) coupled to an intermediate pipe (106) and having an expander pipe cross-sectional area extending substantially perpendicular to the burner pipe axis (104) that is greater than a first pipe cross-sectional area, wherein the low calorific gas flows successively through the first pipe and expander pipe (112), the intermediate pipe (106) extending between the first pipe and the expander pipe (112) to reduce a velocity of the low calorific gas flow;

obstructing a central portion of the expander pipe cross-sectional area with a hub (120) disposed in a downstream portion of the expander pipe (112) to create a perimeter gas flow (152) along the expander pipe (112) through a plurality of guide vanes (130) that interconnect the expander pipe (112) and the hub (120), each of the guide vanes includes a guide vane upstream surface (132) facing the upstream portion of the expander pipe (112);

rotating the perimeter gas flow (152) about the burner pipe axis (104) to create a swirling gas flow exiting the expander pipe (112); and generating a recirculation zone (154) downstream of the expander pipe (112) by directing the swirling gas flow radially outwardly along an exterior surface (146) of a deflector (140), the deflector exterior surface (146) having a substantially frustoconical shape.

17. The method of claim 16, in which the deflector exterior surface (146) is oriented at a deflector surface angle (β) relative to the burner pipe axis (104), and in which the deflector surface angle (β) is approximately 20 to 45 degrees.

18. The method of claim 16, in which each of the guide vane upstream surfaces (132) is oriented at a guide vane angle (α) relative to the burner pipe axis (104), wherein the guide vane angle (α) is approximately 20 to 45 degrees.

19. The method of claim 16, in which the hub (120) defines a maximum hub cross-sectional area extending substantially perpendicular to the burner pipe axis (104), and in which the maximum hub cross-sectional area is approximately 30 to 50 percent of the expander pipe cross-sectional area.

20. The method of claim 16, in which:

the expander pipe (112) is cylindrical and defines an expander pipe diameter (D3);

the deflector (140) includes a deflector downstream end (144) defining a deflector downstream end diameter (D6); and the deflector downstream end diameter (D6) is approximately 60 to 80 percent of the expander pipe diameter (D3).

* * * * *